US005766443A

United States Patent [19]

Hillrichs et al.

[11] Patent Number: 5,766,443

[45] Date of Patent: Jun. 16, 1998

[54] PROCESS OF PREPARING SOLUTIONS OF ALKALI PEROXIDE AND PERCARBONATE

[75] Inventors: Eilhard Hillrichs, Büdingen; Ulrich Sander, Friedrichsdorf, both of Germany

[73] Assignee: Metallgesellschaft Aktiengesellschaft, Frankfurt am Main, Germany

[21] Appl. No.: 569,183

[22] PCT Filed: May 10, 1994

[86] PCT No.: PCT/EP94/01506

§ 371 Date: Jan. 2, 1996

§ 102(e) Date: Jan. 2, 1996

[87] PCT Pub. No.: WO94/28198

PCT Pub. Date: Dec. 8, 1994

[30] Foreign Application Priority Data

May 25, 1993 [DE] Germany ..... 43 17 349.7

[51] Int. Cl.[6] ..... C25B 1/30

[52] U.S. Cl. ..... 205/343; 205/465; 205/466; 205/468

[58] Field of Search ..... 205/343, 465, 205/466, 468

[56] References Cited

U.S. PATENT DOCUMENTS

| | | | |
|---|---|---|---|
| 4,693,794 | 9/1987 | Chiang | 205/466 |
| 4,921,587 | 5/1990 | Dong et al. | 205/466 |
| 5,074,975 | 12/1991 | Oloman et al. | 205/465 |

FOREIGN PATENT DOCUMENTS

88/03966 6/1988 WIPO .

OTHER PUBLICATIONS

Otsuka et al. "One Step Synthesis of Hydrogen Peroxide Through Fuel Cell Reaction" (1990) pp. 319–322.

Industrial Electrochemistry, "Electrodes for Electrolysis and Power Generation" by Yeager Plenum Press 1982, p. 31.

*Primary Examiner*—Arun S. Phasge
*Attorney, Agent, or Firm*—Michael J. Striker

[57] ABSTRACT

The process for preparing an aqueous alkaline solution containing a peroxide and/or percarbonate includes providing an electrochemical cell comprising a porous oxygen diffusion cathode including a carbon woven or nonwoven fabric, a gas diffusion anode containing a carbon woven or nonwoven fabric and fed gaseous hydrogen or an anode including a metal grid coated with a noble metal catalyst and coated on a side facing the cathode with a proton-permeable membrane acting as a solid polymer electrolyte, an electrolyte-containing chamber between the cathode and the anode containing an electrolyte and a direct current source connected across the anode and cathode; feeding an aqueous feed solution containing at least one alkali hydroxide and/or alkali carbonate in a concentration of from 30 to 180 g/l into the electrolyte-containing chamber to provide the electrolyte; supplying an oxygen-containing gas containing molecular oxygen to the carbon woven or nonwoven fabric of the cathode; operating the direct current source to provide an external cell voltage of from 0.5 to 2.0 volts across the anode and the cathode; and withdrawing, from the electrolyte in the chamber, the aqueous alkaline solution containing the peroxide and/or percarbonate as a product characterized by an $H_2O_2$/alkali molar ratio of less than 4.

11 Claims, 2 Drawing Sheets

PROCESS OF PREPARING SOLUTIONS OF ALKALI PEROXIDE AND PERCARBONATE

This application is a 371 continuation of PCT EP94/01506 filed May 10, 1994.

BACKGROUND OF THE INVENTION

This invention relates to a process of preparing aqueous alkaline solutions of peroxide and/or percarbonate in an electrochemical cell, which comprises a porous oxygen diffusion cathode and an anode.

Peroxide solutions are increasing in importance as oxidizing and lead bleaching chemicals, because the reaction product derived from the peroxide used as an oxidizing agent does not pollute the environment. For instance, alkaline aqueous hydroperoxide solutions are used to bleach wood pulp and paper. Hydrogen peroxide and sodium hydroxide solution are used as starting materials for making the bleaching solution are mixed to form sodium peroxide or sodium hydroperoxide in an aqueous solution. Bleaching agents may also consist of sodium percarbonate-containing solutions, which are prepared by a mixing of sodium carbonate-containing and hydrogen peroxide-containing solutions. Because hydrogen peroxide is a relatively unstable compound and strict safety requirements must be met for its transportation, storage and handling, it is much simpler and more desirable to prepare peroxide solutions by electrochemical methods directly at the location at which they are to be used.

E. Yeager (Industrial Electrochemistry, Plenum Press, 1982, page 31) has disclosed an electrochemical cell which is operated like a fuel cell to prepare a peroxide solution without an application of an external voltage. That cell comprises a hydrogen diffusion anode, a KOH electrolyte and an oxygen diffusion cathode, which is supplied with air. A disadvantage of that electrochemical cell resides in that the current density is low so that peroxide is produced at such a low rate that peroxide apparently cannot economically be made by that process.

SUMMARY OF THE INVENTION

It is an object of the invention to provide an economical process of preparing an aqueous alkaline solution of peroxide and/or percarbonate in an electrochemical cell.

That object is accomplished in accordance with the invention in that the cell is operated at a low external cell voltage, an electrolyte which contains alkali hydroxide and/or alkali carbonate is passed in the cell through the chamber disposed between the oxygen diffusion cathode and the anode, alkali peroxide and/or alkali percarbonate is formed by a reduction of oxygen at the cathode, and the $H_2O_2$/alkali molar ratio is less than 4.

According to a preferred feature of the invention the cell is operated at the low external cell voltage of 0.5 to 2.0 V.

According to a further preferred feature of the process in accordance with the invention the alkali hydroxide solution contains 30 to 180 g/l alkali hydroxide or alkali carbonate and the product solution contains 1 to 100 g/l $H_2O_2$.

According to a further preferred feature of the invention NaOH or KOH is used as an alkali hydroxide and $Na_2CO_3$ or $K_2CO_3$ is used as an alkali carbonate.

According to a further preferred feature of the invention the solution of alkali hydroxide contains 50 to 100 g/l alkali hydroxide or alkali carbonate and the product solution contains 10 to 70 g/l $H_2O_2$.

According to a further preferred feature of the process in accordance with the invention a chelating agent or at least a salt of a chelating agent is added to the electrolyte solution.

According to a further feature of the invention the chelating agent consists of ethylenediaminetetraacetic acid (EDTA) and the alkali salts are used as salts of the chelating agent.

According to a further preferred feature of the invention the porous oxygen diffusion cathode consists of a carbon woven or nonwoven fabric coated with a mixture of polytetrafluororethylene and carbon black.

According to a further feature of the invention the oxygen diffusion cathode is supplied with air or oxygen-enriched air or oxygen.

According to a further preferred feature of the process in accordance with the invention a hydrogen diffusion anode is used as an anode and consists of a carbon woven or nonwoven fabric and of a mixture of polytetrafluoroethylene, carbon black, and noble metal and is covered by a proton-permeable membrane.

According to a further feature of the invention the proton-permeable membrane consists of a non-porous cation exchange membrane or of a gas- and electrolyte-impermeable microporous membrane.

According to a further preferred feature of the process in accordance with the invention a depolarized metal electrode which has a network-like or grid-like structure and is coated with a noble metal and/or noble metal oxide catalyst is used as an anode and is covered on its cathode side with a cation exchange membrane as a solid polymer electrolyte and a gas, a liquid or a substance dissolved in a liquid is used as a depolarizer. The catalyst may consist, e.g., of the noble metal ruthenium, rhodium, palladium, rhenium, iridium and/or platinum and/or the oxides thereof.

According to a further preferred feature of the invention, cation exchange membrane is provided between the two gas diffusion electrodes, the aqueous solution containing alkali hydroxide and/or alkali carbonate is supplied to the cathode chamber, and the alkaline solution of peroxide and/or percarbonate is subsequently passed through the anode chamber.

According to a further preferred feature of the invention the carbonate-containing aqueous solution of an alkali hydroxide and/or alkali carbonate is used as a starting material and may be contaminated with polyvalent cations and other mineral components and has a pH from 8 to 13 and a salt concentration between 10 g/l and the solubility limit of the starting material. The starting material is subsequently filtered, the filtrate having a pH from 8 to 13 is caused to flow in contact with a selective cation exchange material for an absorption of divalent and polyvalent cations, and the solution is supplied to the electrochemical cell.

According to a further feature of the process in accordance with the invention a sodium carbonate-containing mineral or the sodium carbonate-containing solids which have been formed by a thermal decomposition of peroxide bleaching liquor used to bleach paper or wood pulp is or are used as a starting material for preparing the sodium carbonate-containing solution.

BRIEF DESCRIPTION OF THE DRAWINGS

The subject matter of the invention will now be explained more in detail with reference to the drawings (FIGS. 1 and 2).

DESCRIPTION OF THE PREFERRED EMBODIMENTS

Figure 1:
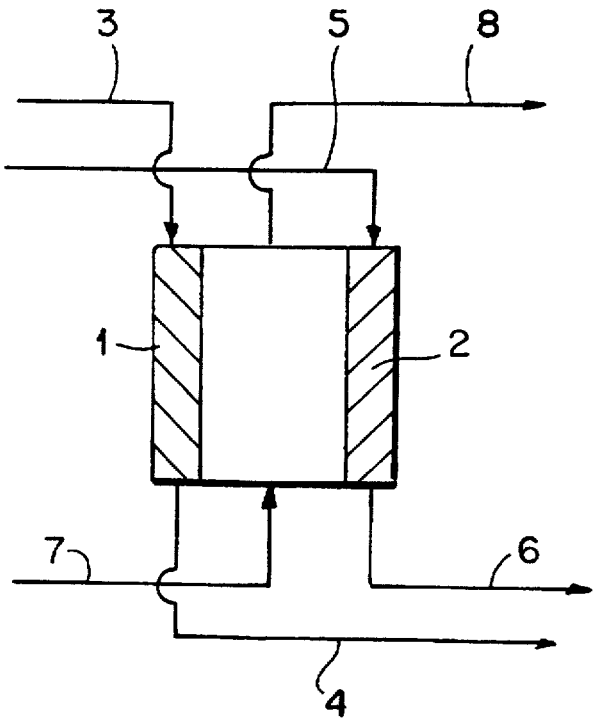
FIG. 1 shows an electrolytic cell with the associated lines, which comprises an oxygen diffusion cathode and a hydrogen diffusion anode.

FIG. 1 shows the electrolytic cell, which comprises an oxygen diffusion cathode 1 and a hydrogen diffusion anode 2. The cathode is composed of two perforated nickel plates, between which a porous carbon woven fabric having a thickness of about 0.4 mm and coated with a mixture of polytetrafluoroethylene and carbon black is disposed. Oxygen or air under a pressure of 0.02 to 0.1 bar is supplied through a line 3 to the rear side of that oxygen diffusion cathode 1. The oxygen diffusion cathode is de-aerated through a line 4. The hydrogen-diffusion anode 2 consists of a carbon woven fabric, which is coated with a mixture of polytetrafluoroethylene and carbon black and is additionally activated with a platinum catalyst. The rear surface of the carbon woven fabric of the hydrogen diffusion anode is forced against a sheet of corrosion-resisting steel. The front surface of the woven fabric is covered with a proton-permeable cation exchange membrane (e.g., NaFION 117, DuPont, U.S.A.) in order to separate the hydrogen space of the anode from the anolyte. Hydrogen is supplied under a pressure of 0.02 to 0.1 bar to the carbon woven fabric on the rear of the anode through a line 5. The hydrogen diffusion anode 2 is de-aerated through a line 6. The starting materials are supplied to the electrochemical cell through a line 7. The product solution is withdrawn from the electrochemical cell through a line 8.

Figure 2:
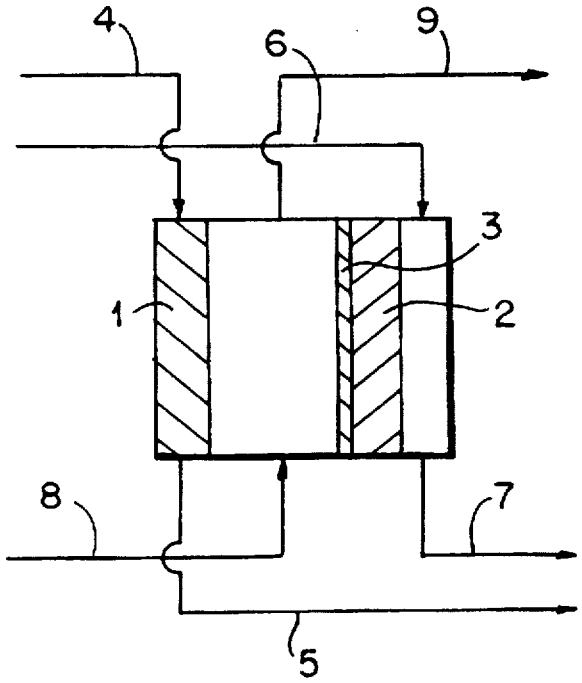
FIG. 2 shows the electrolytic cell with the associated lines, which consists of an oxygen diffusion cathode and a product-permeable depolarized anode provided with solid polymer electrolyte (SPE).

FIG. 2 shows the electrolytic cell which comprises an oxygen diffusion cathode 1 and a product-permeable depolarized anode 2, which is covered on the cathode side with a solid polymer electrolyte (SPE) 3. The cathode is composed of two perforated nickel plates between which a porous carbon woven fabric having a thickness of about 0.4 mm and coated with a mixture of polytetrafluoroethylene and carbon black is disposed. Oxygen or air under a pressure of 0.02 to 0.1 bar is supplied through a line 4 to the rear side of the oxygen diffusion cathode 1. The oxygen diffusion cathode is de-aerated through a line 5. The anode consists of an expanded grid or a network of a corrosion resisting metal or of an electrically non-conducting non-metal, such as graphite or carbon, which is covered on its surface with an electrochemically active metal or metal oxide catalyst. The anode is covered on its cathode side with a proton-permeable cation exchange membrane consisting of a solid polymer electrolyte (SPE 3). The depolarizer consisting of a gas, a liquid or a substance dissolved in a liquid is conducted from the rear side through the line 6 to the surface of the metal anode. The oxidation products formed at the anode are withdrawn through line 7. The depolarizer may consist of hydrogen or methanol (10% by weight) in aqueous sulfuric acid (10 to 20% by weight). The starting materials are supplied to the electrochemical cell through a line 8. The product solution is withdrawn from the electrochemical cell through a line 9.

The invention will be described more in detail hereinafter with reference to examples.

EXAMPLE 1

An electrolytic cell is employed, which comprises an oxygen diffusion cathode and a hydrogen diffusion anode (see FIG. 1). The space between the oxygen diffusion cathode 1 and the hydrogen diffusion anode 2 is supplied with an aqueous $Na_2CO_3$ solution, which contains 60 g/l $Na_2CO_3$ and 1 g/l ethylenediaminetetraacetic acid (EDTA). The electrolytic cell has an electrode surface area of 100 $cm^2$ and an inter-electrode distance of 2 mm and is operated at 35° C. with a current of 10 A. In case of a cathode current efficiency of 70% with respect to $H_2O_2$, 4.4 g/h $H_2O_2$ are formed. In case of a volumetric flow rate of 0.3 l/h through the cathode, this results in a product solution which contains 14 g/l $H_2O_2$. If oxygen is supplied to the cathode in the operation of the electrolytic cell, a cell voltage of 0.95 V is obtained.

EXAMPLE 2

An electrolytic cell is employed which comprises an oxygen diffusion cathode and a hydrogen diffusion anode (see FIG. 1). An aqueous solution which contains 50 g/l NaOH is supplied to the cell. Air is supplied to the oxygen diffusion cathode 1. By an electrolysis with a current of 10 A, a cell voltage of 1.25 V is obtained. The yield of $H_2O_2$ is of the order of that of Example 1.

We claim:

1. A process for preparing an aqueous alkaline solution containing at least one member of the group consisting of peroxides and percarbonates, said process comprising the steps of:

a) providing an electrochemical cell comprising a porous oxygen diffusion cathode including a carbon woven or nonwoven fabric, an anode including a metal grid coated with a noble metal catalyst, said anode being coated on a side thereof facing said cathode with a proton-permeable membrane acting as a solid polymer electrolyte, an electrolyte-containing chamber between the cathode and the anode and containing an electrolyte and a direct current source connected across said anode and said cathode;

b) feeding an aqueous feed solution containing at least one member selected from the group consisting of alkali hydroxides and alkali carbonates in a concentration of from 30 to 180 g/l into said electrolyte-containing chamber to provide said electrolyte;

c) supplying an oxygen-containing gas containing molecular oxygen into the carbon woven or nonwoven fabric of said cathode;

d) operating said direct current source to provide an external cell voltage of from 0.5 to 2.0 volts; and e) withdrawing, from the electrolyte in said chamber, the aqueous alkaline solution containing said at least one member of the group consisting of peroxides and percarbonates as a product;

so that an $H_2O_2$/alkali molar ratio of said product is less than 4.

2. The process as defined in claim 1, wherein the aqueous feed solution contains a chelating agent.

3. The process as defined in claim 1, wherein said proton-permeable membrane consists of a non-porous cation exchange membrane.

4. The process as defined in claim 1, wherein said proton-permeable membrane consists of a microporous membrane which is gas-impermeable and electrolyte-impermeable.

5. The process as defined in claim 1, wherein the aqueous feed solution is contaminated with polyvalent cations and other mineral components and has a pH from 8 to 13 and a salt concentration between 10 g/l and a solubility limit of the aqueous feed solution, and further comprising filtering the aqueous feed solution to form a filtrate having a pH from 8 to 13 and flowing the filtrate in contact with a selective cation exchange material for absorption of divalent cations and said polyvalent cations prior to feeding the aqueous feed solution to the electrolyte-containing chamber in the electrochemical cell.

6. The process as defined in claim 5, further comprising forming a sodium carbonate-containing mineral or a sodium carbonate-containing solid by a thermal decomposition of a peroxide bleaching liquor used to bleach paper or wood pulp and using said sodium carbonate-containing mineral or solid to prepare said aqueous feed solution.

7. A process for preparing an aqueous alkaline solution containing at least one member of the group consisting of peroxides and percarbonates, said process comprising the steps of:

a) providing an electrochemical cell comprising a porous oxygen diffusion cathode including a carbon woven or nonwoven fabric, a gas diffusion anode containing a carbon woven or nonwoven fabric, an electrolyte-containing chamber between the cathode and the anode containing an electrolyte and a direct current source connected across said anode and said cathode;

b) feeding an aqueous feed solution containing at least one member selected from the group consisting of alkali hydroxides and alkali carbonates in a concentration of from 30 to 180 g/l into said electrolyte-containing chamber to provide said electrolyte;

c) supplying an oxygen-containing gas containing molecular oxygen into the carbon woven or nonwoven fabric of said cathode;

d) feeding gaseous hydrogen to the carbon woven or nonwoven fabric contained in said gas diffusion anode;

e) operating said direct current source to provide an external cell voltage of from 0.5 to 2.0 volts; and f) withdrawing, from the electrolyte in said chamber, the aqueous alkaline solution containing said at least one member of the group consisting of peroxides and percarbonates as a product;

so that an $H_2O_2$/alkali molar ratio of the product is less than 4.

8. The process as defined in claim 7, wherein the aqueous feed solution contains a chelating agent.

9. The process as defined in claim 7, wherein said electrolyte-containing chamber is divided into an anode chamber and a cathode chamber by a cation exchange membrane provided between the two electrodes, said aqueous feed solution is fed into the cathode chamber and the product is withdrawn from the anode chamber.

10. The process as defined in claim 7, wherein the aqueous feed solution is contaminated with polyvalent cations and other mineral components and has a pH from 8 to 13 and a salt concentration between 10 g/l and a solubility limit of the aqueous feed solution, and further comprising filtering the aqueous feed solution to form a filtrate having a pH from 8 to 13 and flowing the filtrate in contact with a selective cation exchange material for absorption of divalent cations and said polyvalent cations prior to feeding the aqueous feed solution to the electrolyte-containing chamber in the electrochemical cell.

11. The process as defined in claim 10, further comprising forming a sodium carbonate-containing mineral or a sodium carbonate-containing solid by a thermal decomposition of a peroxide bleaching liquor used to bleach paper or wood pulp and using said sodium carbonate-containing mineral or solid to prepare said aqueous feed solution.

* * * * *